US006479117B1

(12) United States Patent
Phillips et al.

(10) Patent No.: US 6,479,117 B1
(45) Date of Patent: Nov. 12, 2002

(54) COMBINED WATERPROOFING SHEET AND PROTECTION COURSE MEMBRANE

(76) Inventors: Aaron R. Phillips, 916 E. 27th St., Baxter Springs, KS (US) 66713; Grant Mitchell, 2811 Kansas Ave., Joplin, MO (US) 64804

( * ) Notice: Subject to any disclaimer, the term of this patent is extended or adjusted under 35 U.S.C. 154(b) by 0 days.

(21) Appl. No.: 09/118,121

(22) Filed: Jul. 16, 1998

(51) Int. Cl.[7] ..... E02D 31/02

(52) U.S. Cl. ..... 428/40.1; 52/169.14; 52/309.1; 52/309.3; 428/40.1; 428/40.3; 428/141; 428/147; 428/483; 428/911

(58) Field of Search ..... 428/40.1, 911, 428/40.3, 141, 147, 483; 52/169.14, 309.1, 309.3

(56) References Cited

U.S. PATENT DOCUMENTS

| | | | | |
|---|---|---|---|---|
| 3,625,794 A | * 12/1971 | Arikawa | 156/244 |
| 4,160,058 A | 7/1979 | K-Gall | 428/286 |
| 4,368,228 A | 1/1983 | Gorgati | 428/110 |
| 4,420,524 A | 12/1983 | Gorgati | 428/110 |
| 4,749,609 A | 6/1988 | Lempereur | 428/255 |
| 4,775,567 A | 10/1988 | Harkness | 428/40.1 |
| 5,318,832 A | 6/1994 | Fishel et al. | 428/287 |

FOREIGN PATENT DOCUMENTS

| | | |
|---|---|---|
| GB | 2064369 | * 6/1981 |
| JP | 6-278247 | * 10/1994 |

OTHER PUBLICATIONS

MEL–GARD—W.R. Meadows, Inc., Elgin, IL—"Protecte" Waterproofing Membrane, 4 pages.

* cited by examiner

*Primary Examiner*—Nasser Ahmad
(74) *Attorney, Agent, or Firm*—Shook, Hardy & Bacon LLP

(57) ABSTRACT

A combined waterproofing sheet and protection course membrane has a water resistant film and a protective layer. The protective layer protects the film from being punctured and otherwise compromised. An adhesive layer, with a free adhesive side for adhesion to a foundation, is adhered to the film, so that the membrane can be applied to a subterranean foundation in a single step. While the foundation is being back filled, the protective layer keeps the water resistant film intact thereby maintaining the water resistant capabilities of the membrane.

16 Claims, 1 Drawing Sheet

COMBINED WATERPROOFING SHEET AND PROTECTION COURSE MEMBRANE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to combined waterproofing sheet and protection course membranes and, more particularly, to combined subterranean waterproofing sheet and protection course membranes for sealing subterranean building foundations and methods of installation therefor.

It is common to construct both residential homes and commercial buildings with subterranean foundations, typically made from concrete, which may define basements. Utilization of basement space for storage, living quarters, offices, etc. requires that the foundation be essentially leak proof. Therefore, devices and methods for their use have been developed to prevent water from leaking through foundations and entering basements.

In residential applications, it is common to spray foundations with a tar like substance and back fill the foundations with dirt. The spray forms a coating on the foundation to help seal out water and water vapor. The coatings, however, have limited capabilities to prevent water from leaking into the basement. A more expensive and effective sealing technique utilizes membrane sheets which are adhered to the foundation. The membrane sheets bear some similarity to known waterproofing laminates that are used on roofs, such as the particular laminate disclosed in U.S. Pat. No. 4,775,567 to Harkness. The membrane of the Harkness patent has an adhesive layer of modified bitumen and an elastomeric sheet to form an effective water resistant barrier. Waterproof laminates bearing some similarity to Harkness are, however, subject to compromise by cuts and especially punctures, and if the waterproofing sheet is punctured, it will not prevent water penetration. Therefore, before the structure is back filled with dirt, a protective sheet is held or attached over the waterproof laminate to prevent damage to the waterproof laminate during back fill. This requires that two separate sheets be applied in two separate steps, and thus, it is a labor intensive process.

A method for sealing a surface which results in a waterproof covering membrane is also disclosed in U.S. Pat. No. 4,160,058 to K-Gall. In the K-Gall patent, a coating is applied to the structure, a textile layer is laid on the coating, and a second coating is applied over the textile layer. Thus, the K-Gall patent discloses a labor intensive installation process requiring three separate steps.

Water resistant membranes have been used in various applications including roofing, as taught by U.S. Pat. No. 4,420,524 to Gorgati, to prevent water from leaking into buildings. The membrane disclosed by the Gorgati patent has a reinforcing layer and an adhesive to attach the membrane. However, such membranes have not been used in subterranean applications because they do not provide the required resistance to water penetration. The membrane of the Gorgati patent, for example, does not provide a water resistant film.

Thus, reduction in the required labor to install water resistant membranes on subterranean foundations is an important feature in reducing the cost of installing the membranes.

BRIEF SUMMARY OF THE INVENTION

One object of the invention is to provide a novel combined waterproofing sheet and protection course membrane for protecting a surface from water penetration. The membrane has a water resistant film and a protective layer. The protective layer is positioned relative to the film to protect the film from damage. Being resistant to both water penetration and puncture, the membrane is especially suited for use in sealing subterranean foundations against water penetration. In a preferred embodiment, a self-adhesive layer is adhered to the water resistant film to speed installation, and a release liner covers a free adhesive side of the adhesive layer to protect it prior to installation.

The invention is further directed to a novel method for sealing a subterranean foundation in preparation for back filling. A combined waterproofing sheet and protection course membrane is provided with a self-adhesive layer, and the self-adhesive layer is adhered to the foundation. Thus, the membrane is installed and the foundation sealed with a single step. If multiple membranes are required, they are overlapped in the vertical or horizontal directions.

Accordingly, it is an object of the present invention to provide an improved water resistant membrane for subterranean foundations with both a water resistant film and a protective layer.

It is a further object of the present invention to provide an improved water resistant membrane with a water resistant film, a protective layer, and a self-adhesive layer for reduced labor and installation cost.

A still further object is to provide an improved membrane capable of acting as a protective layer functioning as a channel for water flow to perimeter drains.

BRIEF DESCRIPTION OF THE SEVERAL VIEWS OF THE DRAWING

These and other features, advantages, and objects will appear from the following detailed description of a preferred embodiment of the invention, wherein.

DETAILED DESCRIPTION OF THE INVENTION

Figure 1:
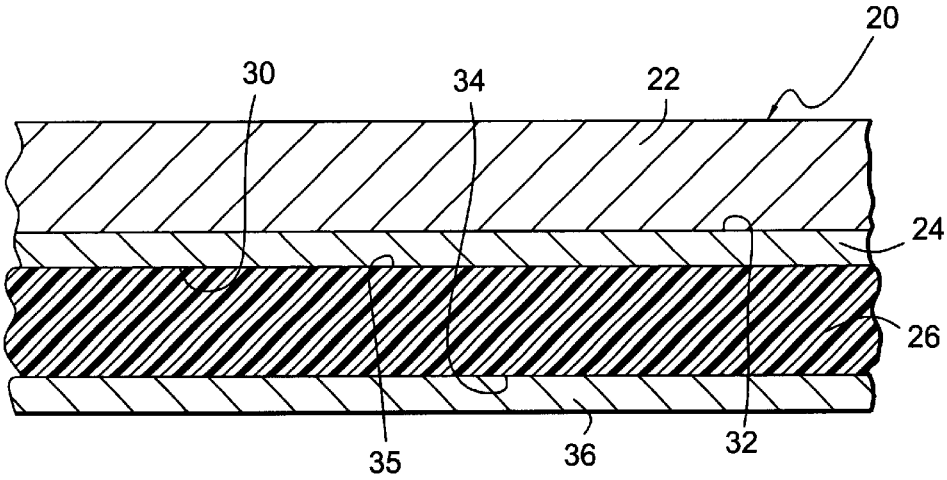
FIG. 1 is a schematic cross-sectional view of a self-adhesive combined waterproofing sheet and protection course membrane according to the present invention.

Referring to the drawings in greater detail, and particularly to FIG. 1, a self-adhesive combined waterproofing sheet and protection course membrane 20 is shown. The layers of the membrane are enlarged for clarity though not necessarily in proportion. The prefabricated membrane 20 has a puncture resistant protective layer 22, a water resistant film 24 which is substantially impenetrable to water and water vapor, and a self-adhesive layer 26 that is applied to the membrane 20 so that the membrane can be applied to a foundation 28 (FIG. 2) in a single application step. The membrane 20 is prefabricated in that it is completely manufactured prior to installation.

The puncture resistant protective layer 22 is preferably made from non-woven polyester having a puncture resistance greater than about 50 lbs., as measured by ASTM E154-88. Additionally or alternatively, polypropylene, organic felt paper, and glass fiber may be used. It is also possible, though less desirable, to use woven materials as the protective layer 22. To achieve the desired resistance to puncture and cuts thereby increasing the protection of the water resistant film 24, the protective layer 22 has a weight greater than approximately 150 grams/$m^2$ ($1.5\times10^2$ grams/$m^2$), and preferably about 170 grams/$m^2$.

The water resistant film 24 is preferably made from polypropylene though other materials such as polyethylene, polyvinylchoride (PVC), polyester, polystyrene, polyimide, polyamide, polybutylene, and polycarbonate are used alternatively or additionally. The water resistant film 24 preferably has a water permeability less than approximately 0.01 perm ($1\times10^{-2}$ perm) where perm is the unit of measurement for permeance. The film has a preferred thickness in the range of approximately 0.5 to approximately 3.0 mils, although thinner films may be developed that provide the necessary water resistance and are thus suitable for use in the present application. Although the self-adhesive layer 26 also imparts some water resistance to the finished laminate, the film 24 provides the low water permeability to both water vapor and liquid water necessary for subterranean applications. Thus, the film 24 provides true waterproofing.

The film 24 has first and second sides comprising a foundational side 30 and an outer side 32. The foundational side 30 faces the foundation 28 (FIG. 2), or other surface to be sealed and the outer side 32 faces away from the foundation (or other surface) after the membrane is applied. If the film 24 is punctured or cut, it looses its ability to prevent water penetration, so the protective layer 22 is provided in the combined membrane 20 to prevent damage to the film. To that end, the protective layer 22 is preferably connected to the outer side 32 of the film 24, so that the film 24 is positioned between the protective layer 22 and the foundation 28. With the protective layer 22 outside the film 24, any back fill material striking the membrane 20 will hit the protective layer not the film. Therefore, the film 24 is held safely between the protective layer 22 and the foundation 28.

The adhesive layer 26 is applied to at least a portion of one of either the protection layer 22 or the film 24. Preferably, the adhesive layer 26 is applied to the entire foundational side 30 of the film 24, so that the film 24 is positioned between the adhesive layer 26 and the protective layer 22. The adhesive layer 26 is made from a polymer-modified bitumen, and preferably comprises a styrene-butadiene-styrene (SBS) polymer. Also, the bitumen may include one or more additional and/or substitute additives selected from the group consisting of ABA block copolymers such as SEBS and SIS, A-B block copolymers such as SBR, and other additives such as IPP, APP, butyl rubber, natural rubber, polyisobutylene, and nitrile. The adhesive layer 26 has a free adhesive side 34 for adherence to the foundation 28 and an attached side 35 adhering to the film 24. The free adhesive side 34 is preferably protected by a removable release liner 36. The release liner 36 covers the free adhesive side 34 protecting it during storage and transport. The release liner 36 is removed for installation, so that the free adhesive side 34 can be attached to the foundation 28, as shown in FIG. 2.

To form the membrane 20 shown in FIG. 1, the film 24 is uniformly coated onto the protective layer 22. This is accomplished by feeding the protective layer 22 into one end of a coating machine from a large diameter roll containing many linear feet. The coating machine then coats the protective layer 22 with the film 24 by extruding the film in a liquid state uniformly over the surface of the protective layer to form a coherent film on one side of the protective layer. Alternatively, a film may be laminated to the protective layer through any of several laminating methods. In one laminating method, a polymer having a melting point lower than both the film and the protective layer is extruded between the film and the protective layer, where it hardens and effectively bonds the two layers together. Heat bonding and use of other adhesives are additional laminating techniques that may be employed. The combined protective layer and water resistant film is then fed into another coating machine which applies the adhesive layer 26 to finish forming the membrane 20. The finished membrane is typically provided as 3 to 4 foot wide rolls up to 100 feet in length. The membranes can be provided in sheets of any desired dimensions, limited only by manufacturing capabilities.

Figure 2:
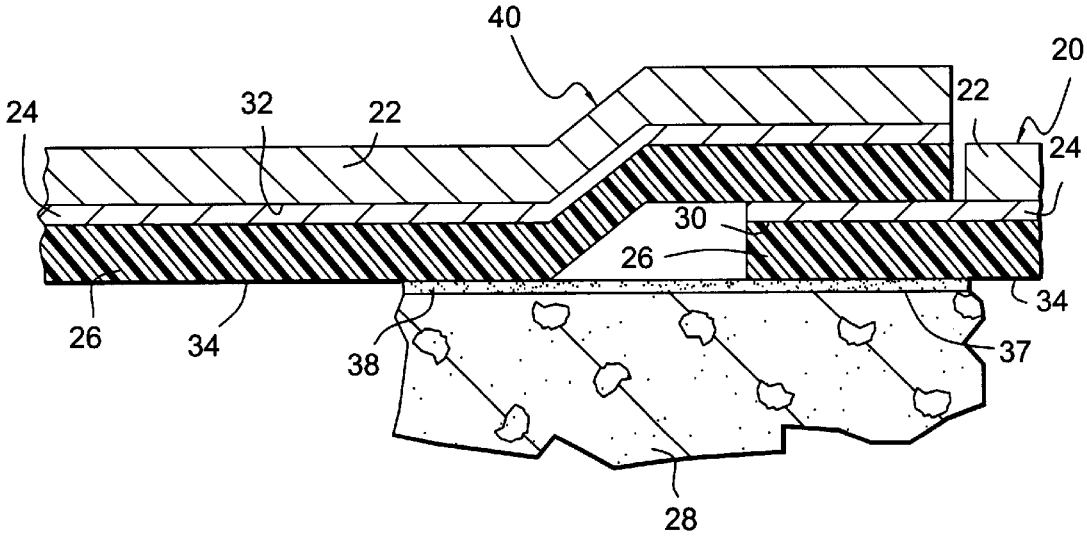
FIG. 2 is a schematic cross-sectional view of the self-adhesive combined waterproofing sheet and protection course membrane shown in FIG. 1 and a second combined membrane after application to a foundation.

To install the membrane as shown in FIG. 2, the foundation 28 is preferably prepared for installation. Preparation involves filling voids in the foundation, breaking off any protrusions such as form ties, cleaning, and priming with a primer coating 38. The primer coat 38 operates to both capture and remove dust from the foundation and seal any small pores in the foundation for better adhesion. The release liner is then removed from the membrane 20, and the membrane 20 is adhered to the prepared foundation 28. During application of the membrane to the foundation, the membrane is hand smoothed or rolled to remove wrinkles. The membrane 20 is preferably applied to the outside 37 of the foundation. Thus, the membrane is referred to as a "positive side" membrane because pressure from water and back fill materials push the membrane toward the foundation as opposed to "negative side" (inside) where water pressure pushes the membrane away from the foundation. After the membrane is put in place, the foundation can be back filled. The protective layer 22 which is positioned outside the film relative to the foundation 28, protects the film as dirt and rocks are pushed into the opening around the foundation.

If a single membrane 20 does not cover the desired area, one or more additional membranes 40 are adhered to the foundation 28 in an overlapping relationship to the first membrane 20. The line or area of overlap between two adjacent membranes preferably extends vertically, and each membrane is preferably formed with one marginal edge along which the film 24 is exposed, or along which the protective layer thereof may be removed to expose the film (See FIG. 2). This marginal edge may also be formed on membrane 20 with similarly oriented flap of protective layer that is not adhered to the film 24 so as to be easily cut or torn (if perforated) away to expose the film thereunder. By providing this construction, the adhesive layer associated with each membrane can be adhered to the exposed surface of the adjacent membrane, facilitating adhesion between the two membranes and improving the waterproofing ability of the installation. Further, the membranes can be cut to any desired size.

Thus, a combined waterproofing sheet and protection course membrane and method of use therefor are disclosed which utilize a water resistant film combined with a protective layer and an adhesive layer to more efficiently install membranes on subterranean foundations. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A combined waterproofing sheet and protection course membrane for protecting a surface from water penetration, the membrane comprising:

a water resistant film with low water permeability and having an outer side and a foundational side;

a protective layer attached to the outer side of the water resistant film to protect the film from damage; and a self-adhesive layer having a free adhesive side for adhesion to the surface to be protected from water penetration and having an attached side adhered to one of the film and the protective layer.

2. The membrane according to claim 1 wherein the protective layer comprises non-woven polyester having a puncture resistance greater than about 50 lbs., as measured by ASTM E154-88.

3. The membrane according to claim 1 wherein the water resistant film comprises polypropylene having water permeability less than approximately $1\times10^{-2}$ perm.

4. The membrane according to claim 1 wherein the adhesive layer is adhered to the foundational side of the water resistant film.

5. The membrane according to claim 1 wherein the film is positioned between the protective layer and the surface after installation on the surface.

6. The membrane according to claim 1 wherein the adhesive layer comprises an SBS polymer-modified bituminous adhesive.

7. The membrane according to claim 1 further comprising a release liner covering the free adhesive side of the self-adhesive layer whereby the self-adhesive layer is protected prior to installation.

8. The membrane according to claim 1 wherein the water resistant film is held between the protective layer and the self-adhesive layer.

9. A combined waterproofing sheet and protection course membrane for sealing a subterranean foundation against water penetration, the membrane comprising:

a water resistant film with low water permeability and having an outer side and a foundational side;

a protective layer attached to the outer side of the water resistant film so that the protective layer is outside the water resistant film after installation to protect the film from damage, and a self-adhesive layer having a free adhesive side for adhesion to the subterranean foundation to be protected from water penetration and having an attached side adhered to one of the water resistant film and protective layer.

10. The membrane according to claim 9 wherein the self-adhesive layer is adhered to the foundational side of the water resistant film.

11. The membrane according to claim 9 further comprising a release liner covering the free adhesive side prior to installation to protect the free adhesive side prior to installation.

12. A combined waterproofing sheet and protection course membrane for protecting a surface from water penetration, the membrane comprising:

a water resistant film with low water permeability and having an outer side and a foundational side;

a protective layer attached to the outer side of the water resistant film to protect the film from damage, the protective layer including a marginal edge along which the protective layer may be removed to expose the water resistant film; and a self-adhesive layer having a free adhesive side for adhesion to the surface to be protected from water penetration and having an attached side adhered to one of the film and the protective layer.

13. The membrane according to claim 12, wherein the marginal edge is a perforated.

14. The membrane according to claim 12, wherein the portion of the protective layer that can be removed along the marginal edge is not adhered to the water resistant film.

15. The membrane according to claim 12 wherein the adhesive layer is adhered to the foundational side of the water resistant film.

16. The membrane according to claim 12 further comprising a release liner covering the free adhesive side of the self-adhesive layer whereby the self-adhesive layer is protected prior to installation.

* * * * *